United States Patent [19]

Tischer et al.

[11] Patent Number: 4,708,678

[45] Date of Patent: Nov. 24, 1987

[54] ADJUSTMENT APPARATUS FOR VIDEO DISPLAY DEVICE AND METHOD THEREFOR

[75] Inventors: Kurt M. Tischer, Wendlingen; Michael Schlipf, Schorndorf; P. Dieter Lesiak; Rolf Wengert, both of Munich, all of Fed. Rep. of Germany

[73] Assignee: Standard Elektrik Lorenz, Stuttgart, Fed. Rep. of Germany

[21] Appl. No.: 876,949

[22] Filed: Jun. 20, 1986

[30] Foreign Application Priority Data

Jun. 21, 1985 [DE] Fed. Rep. of Germany ..... 3522141

[51] Int. Cl.[4] ..... H01J 9/18

[52] U.S. Cl. ..... 445/24; 29/467; 29/281.1

[58] Field of Search ..... 445/24, 25, 67, 47; 29/238, 281.1, 467

[56] References Cited

U.S. PATENT DOCUMENTS 1,885,690 11/1932 Doyle ..... 29/238

3,879,629 4/1975 Durand ..... 445/25

4,613,312 9/1986 Mammach ..... 445/25

FOREIGN PATENT DOCUMENTS 2952528 7/1981 Fed. Rep. of Germany ..... 445/25

39736 3/1985 Japan ..... 445/47

*Primary Examiner*—Kenneth J. Ramsey

*Attorney, Agent, or Firm*—Christie, Parker & Hale

[57] ABSTRACT

An apparatus for the assembly and alignment of a video display device having a base plate and a holding device, the base plate including a plurality of movable adjusting studs projecting therefrom for engaging a plurality of alignment holes located in a plurality of structured plates of the video display device. The holding device includes a plurality of adjustable stops for engaging and aligning a spacing frame and a screen plate. Each alignment hole includes a diameter reducing metal ring to ensure precise alignment of the structured plates which are aligned and joined to the spacing frame and screen plate. The video display device is then removed from the apparatus.

14 Claims, 4 Drawing Figures

ADJUSTMENT APPARATUS FOR VIDEO DISPLAY DEVICE AND METHOD THEREFOR

BACKGROUND OF THE INVENTION

1. Field of the Invention

The invention relates generally to video display devices and more particularly to an alignment apparatus for a video display device.

2. Description of the Prior Art

In the field of video display devices, each display device includes a plurality of structural plates and the precise alignment of these plates is of significant concern. In the prior art, the structural plates were joined together in an adjusted position. In the German patent No. DE-OS 29 52 528, a display device is disclosed in which electrons of a gas discharge are passed through selectively opened holes of a control structure into a plasma-free space where they absorb energy due to the presence of an accelerating voltage. The electrons finally produce dots of lights on a luminescent screen. The central structure includes several structural plates which are each perforated in a regular pattern and bear stripe electrodes. A screen is deposited on a screen plate and consists of phosphor stripes or dots. Each of these structures must be aligned in relation to one another so that the parts are joined together in the adjusted position. For alignment purposes, the screen plate includes adjustment studs which are accurately designed to size and onto which a spacing frame andother structural plates are stacked serially. The spacing frame and the strutural plates have close tolerance openings through which the adjusting studs pass. Additionally, each component part mounted in this manner is aligned visually in relation to a base and affixed provisionally in this position with a high temperature adhesive. The entire unit of structural plates was then soldered at elevated temperatures. However, the apparatus and method of stacking the structural plates is complicated because each screen plate bears precise adjusting studs. Furthermore, this adjustment system included a coarse and a fine adjustment and the adjustment procedure was rather complex and therefore not particularly suited for mass production. There remains a demand for a reliable adjustment apparatus and method suitable for mass production.

SUMMARY OF THE PRESENT INVENTION

It is therefore an object of the present invention to provide an improved method for assembling a video display device.

It is a further object to provide an improved apparatus for assembling a video display device.

Briefly, a preferred embodiment of the present invention includes an apparatus for the assembly and alignment of a video display device. The video display device includes a frontal screen plate with a tub like rear portion and a plurality of structured plates and a spacing frame mounted therebetween, each requiring precise alignment. The alignment apparatus includes a base plate and a holding device attached thereto. A plurality of movable adjusting studs project from the top of the base plate engaging alignment holes in the plurality of structured plates mounted upon the base plate. Also, a plurality of adjustable stops extend from the holding device and engage the spacing frame and screen plates which are mounted upon the plurality of structured plates with sealing glass. Precise alignment of the video display device is permitted by employing a diameter reducing metal ring in each alignment hole of the structured plates ensuring that the center of the metal ring assumes a precise position. The structured plates, spacing frame and screen plate are then joined together at an elevated temperature after which the adjusting studs and adjusting stops are withdrawn permitting the addition of the tub like rear portion. In alternate embodiments, the adjusting studs employing a slider mechanism can engage the alignment holes from opposite directions for independently adjusting the structured plates.

An advantage of the apparatus for the assembly and alignment of a video display device is that an improved method of assembly is disclosed.

Another advantage is that the apparatus for the assembly and alignment of a video display device is that metal ring inserts provide for precise alignment of the structured plates.

These and other objects and advantages of the present invention will no doubt become obvious to those of ordinary skill in the art after having read the following detailed description of the preferred embodiments which are illustrated in the various drawing figures.

IN THE DRAWING

DETAILED DESCRIPTION OF THE PREFERRED EMBODIMENT

Figure 1:
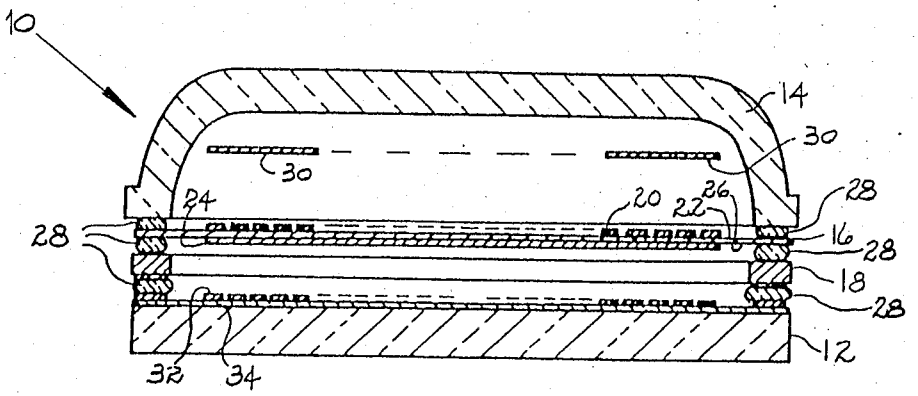
FIG. 1 is a cross-sectional view of a video display device.

FIG. 1 illustrates a video display device referred to by the general reference character 10. The display device 10 includes a screen plate 12 and a tub-like rear portion 14 with a plurality of structured plates 16 and a spacing frame 18 arranged therebetween. The plurality of structured plates 16 include a plurality of row conductors 20 on a first plate side 22 and a plurality of column conductors 24 on a second plate side 26. At each point of intersection of the plurality of row conductors 20 and the plurality of column conductors 24, there exists a hole (not shown). The above mentioned components are joined together with a sealng glass compound 28. In a space enclosed by the tub-like rear portion 14, a plurality of cathodes 30 are mounted. The screen plate 12 is provided with a phosphor screen 32. A continuous post-accelerating anode 34 may be present between the phosphor screen 32 and the screen plate 12.

Figure 2:
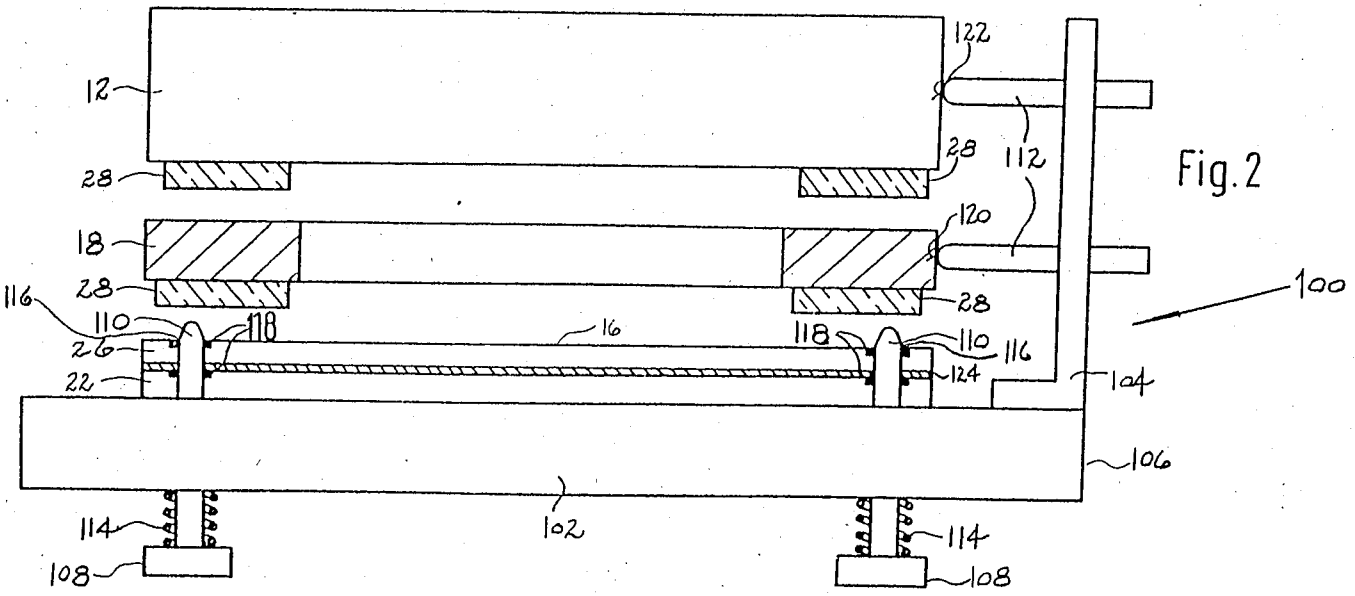
FIG. 2 is a schematic side view of an apparatus for assembling a video display device in accordance with the present invention.

FIG. 2 illustrates an apparatus for the assembly of the video display device 10 referred to by the general reference number 100 and incorporating the present invention. The apparatus 100 includes a base plate 102 and a holding device 104 attached thereto at a first end 106. A plurality of movable adjusting studs 108 having conical ends 110 which project from the top of the base plate 102. The holding device 104 includes a plurality of adjustable stops 112 which project to the left into the area above the base plate 102. Further details concerning the adjustment of the plurality of adjustable stops 112 and the movability of the adjusting studs 108 are not shown. A spring 114 is provided at each of the adjusting studs 108 to assist in translational motion in one direction. Also illustrated in FIG. 2 is the plurality of structured plates 16 comprised of the first plate side 22 and the second plate side 26, a plurality of stud holes 116 each including one of a plurality of metal rings 118, a plurality of stop faces 120 and a plurality of stop faces 122, the screen plate 12, the spacing frame 18 and the sealing glass 28.

To assemble the video display device 10, the adjusting studs 108 in the base plate 102 are moved downward until they no longer project therefrom. The first plate 22 is joined to the second plate 26 by a sealing compound 124 and then placed atop the base plate 102. Near the edges of the first plate 22 and the second plate 26, the plurality of stud holes 116 are machined for engaging the adjusting studs 108. Each of the stud holes 116 are fitted with one of the metal rings 118 for reducing the diameter of the stud holes 116. When the adjusting studs 108 are inserted in the stud holes 116, the metal rings 118 provide for precise alignment of the first plate 22 and the second plate 26. Thus, the metal rings 118 provide the advantage that the plurality of stud holes 116 do not have to be machined with high precision. Care must be taken only to ensure that the center of the metal ring 118 assumes a precise position. The spacing frame 18 provided with the sealing glass 28 is then placed atop the first plate 22 and the second plate 26. Note that the spacing frame 18 has stop faces 120 on the side facing the adjustable stops 112. To adjust the spacing frame 18 in relation to the first plate 22 and the second plate 26, the spacing frame 18 is moved in the right direction until the stop faces 120 touch the adjustable stops 112, as shown in FIG. 2. Then the screen plate 12 is provided with a layer of sealing glass 28 and placed on the spacing frame 18. The screen plate 12 also includes stop faces 122 on the edge facing the adjustable stops 122. When the screen plate 12 is placed onto the spacing frame 18, the screen plate 12 is also moved in the right direction until the stop faces 122 touch the adjustable stops 112. The first plate 22, the second plate 26, the spacing frame 18 and the screen plate 12 are then joined together at an elevated temperature. After the withdrawal of the adjusting studs 108 and the adjustment stops 112, the first plate 22, the second plate 26, the spacing frame 18 and the screen plate 12 are removed from the apparatus 100. The video display device 10 is then assembled with the tub-like rear portion 14 which is provided with the plurality of cathodes 30. It is important that the first plate 22, the second plate 26, the spacing frame 18, the screen plate 12, the sealing glass 28 and the apparatus for assembling the video display device 100 each have the identical coefficient of thermal expansion.

Figure 3:
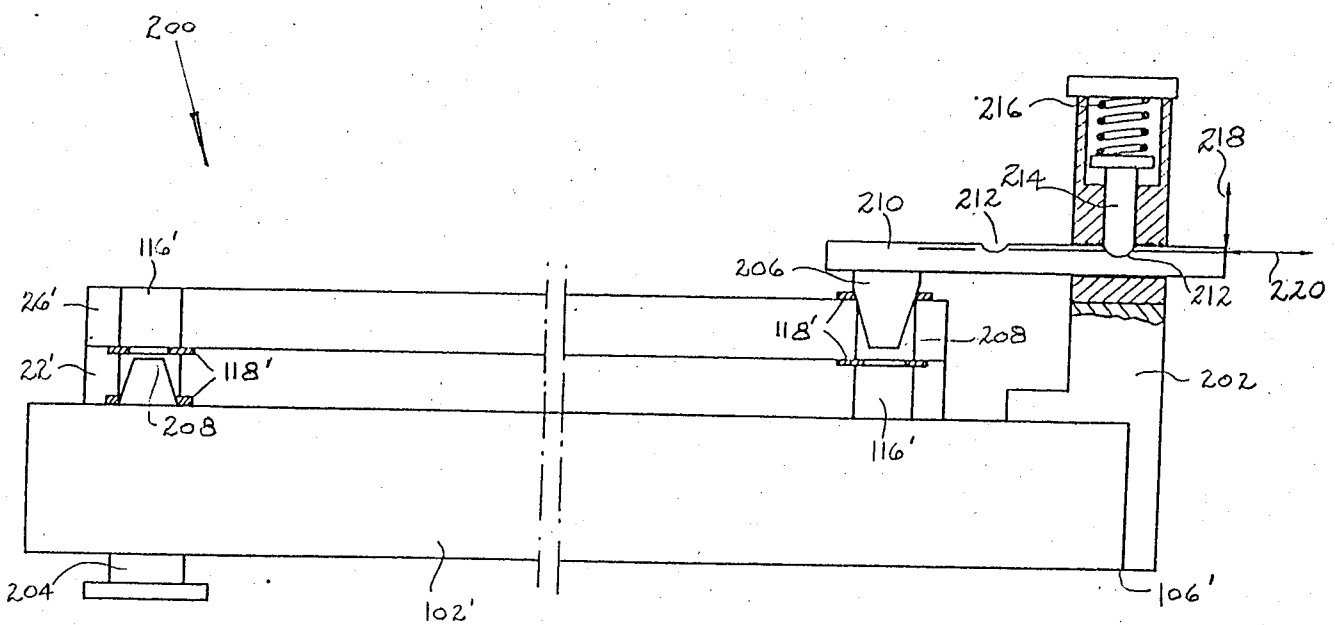
FIG. 3 is a schematic side view of an alternative embodiment of an apparatus for assembling a video display device of the present invention.

FIG. 3 illustrates an alternative embodiment of an apparatus for the assembly of the video display device 10 referred to by the general reference character 200 and incorporating the present invention. Each element common to an identical element of the preferred embodiment is designated by a single prime designation. The apparatus 200 includes a base plate 102', a holding device 202, a first end 106' a plurality of adjusting studs 204, a plurality of adjusting studs 206, a plurality of conical ends 208 of studs 204, 206, a plurality of stud holes 116', a plurality of metal rings 118', a first plate 22', a second plate 26', a slider 210, a plurality of recesses 212, a pin 214 and a spring 216, In embodiment 200, the adjusting studs 204 employed for the adjustment of the first plate 22' placed on top of the base plate 102' are different from those adjusting studs 206 employed to adjust the second plate 26'. Attached to the base plate 102' are the plurality of adjusting studs 204 whose conical ends 208 engage the stud holes 116' and their metal rings 118' of the first plate 22'. From above, the plurality of adjusting studs 206 engage the stud holes 116' with the metal rings 118' of the second plate 26'. The adjusting studs 206 are attached to the slider 210 which includes two recesses 212. The pin 214 provided in the holding device 202 is pressed down by the spring 216 for engaging the recesses 212. The slider 210 is mounted in the holding device 202 such that the slider 210 can be vertically moved up or down as shown by a vertical directional arrow 218 and moved laterally between the lock-in positions as shown by a horizontal directional arrow 220. The spacing frame 18 (shown in FIG. 2) that is placed on first plate 22' and second plate 26' includes a recess (not shown) to accommodate the slider 210 with the adjusting stud 206. This embodiment 200 has the advantage that the first plate 22' and the second plate 26' can be adjusted independent of one another.

Figure 4:
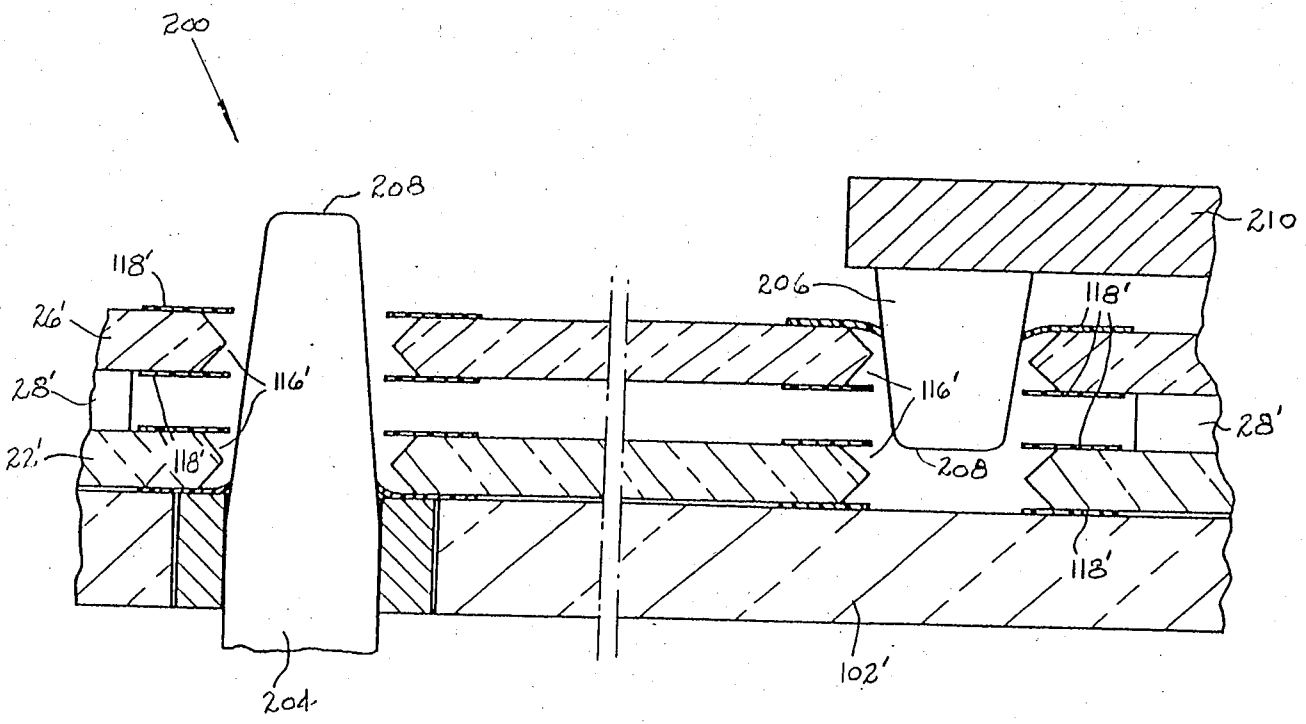
FIG. 4 is a detail schematic diagram of the apparatus for assembling the video display device illustrated in FIG. 3.

FIG. 4 illustrates details for the apparatus for assembling the video display device 10 shown in embodiment 200 of FIG. 3. The left portion of FIG. 4 illustrates the area adjacent to the adjusting stud 204 while the right portion of FIG. 4 illustrates the area adjacent to the adjusting stud 206. The first plate 22' rests on the base plate 102' with its metal rings 118'. Held at a predetermined distance by sealing glass 28', the second plate 26' is placed above first plate 22'. The stud holes 116' in the first plate 22' and the second plate 26' are aligned in relation to each other. With the conical end 208, the adjusting stud 204 slides into the stud holes 116' of the first plate 22' and the second plate 26' through the base plate 102' from below, with the metal ring 118' being bent into stud hole 116' of the first plate 22' touching the adjusting stud 204. Due to the elasticity of the metal ring 118', the first plate 22' is caused to be adjusted. Analogously, the metal ring 118' of the stud hole 116' in the second plate 26' touches the adjusting stud 206 when the stud 206 is inserted from above. Again, the elasticity of the metal ring 118' causes the second plate 26' to be adjusted. The remainder of the assembly procedure is as described above in the preferred embodiment 100 of FIG. 2.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An apparatus for the assembly of a video display device comprising, in combination:

a base plate for supporting a plurality of plates within a video display device;

a holding device in mechanical communication with said base plate, said holding device comprising a plurality of adjustable stops for engaging a spacing frame and a screen plate mounted above said plurality of plates;

a plurality of movable adjusting studs projecting from the bottom of said baseplate to the top of said base plate; and a metal ring fitted to each of a plurality of alignment hoels machined in said plurality of plates, each of said metal rings receiving one of said plurality of adjusting studs from the same direction for providing precise alignment of said video display device.

2. The apparatus of claim 1 wherein each of said adjusting studs includes a conical end projecting above said base plate.

3. The apparatus of claim 1 wherein at least one of said plurality of adjustable stops of said holding device engages at least one of a plurality of stop faces located on said spacing frame.

4. The apparatus of claim 1 wherein at least one of said plurality of adjustable stops of said holding device engages at least one of a plurality of stop faces located on said screen plate.

5. The apparatus of claim 1 wherein each of said plurality of adjusting studs includes a spring for assisting movability of said adjusting stud in one direction.

6. The apparatus of claim 1 wherein each of said metal rings reduces the diameter of each of said respective alignment hole.

7. A method for the assembly of a video display device, said method comprising the steps of:

providing a base plate and a holding device attached to said base plate;

mounting a plurality of movable adjusting studs in said base plate for aligning a plurality of structured plates;

positioning a plurality of adjustable stops on said holding device for laterally aligning a spacing frame and a screen plate;

machining a plurality of alignment holes in each of said structured plates and fitting a metal ring to each of said alignment holes;

withdrawing said adjusting studs from said base plate and mounting said plurality of structural plates on said base plate;

engaging each of said metal rings with an adjusting stud for vertically aligning said plurality of structured plates;

placing said spacing frame above said plurality of structured plates for laterally aligning said spacing frame with said adjustable stops;

placing said screen plate above said spacing frame for laterally aligning said screen plate with said adjustable stops;

joining said plurality of structured plates, said spacing frame and said screen plate at an elevated temperature, and withdrawing said adjusting studs and said adjustable stops from said video display device.

8. An apparatus for the assembly of a video display device comprising, in combination:

a base plate for supporting a plurality of plates within a video display device including at least a first plate and a second plate;

a holding device in mechanical communication with said base plate, said holding device comprising an adjustable slider for aligning said second plate;

a plurality of adjusting studs including at least a first adjusting stud and a second adjusting stud, said first adjusting stud projecting from the bottom of said base plate and said second adjusting stud projecting downward from said adjustable slider;

a metal ring fitted to each of a plurality of alignment holes machined in said plurality of plates, each of said metal rings receiving one of said plurality of adjusting studs with the adjusting studs engaging said first plate being opposed in direction to the adjusting studs engaging said second plate for permitting independent adjustment of said plurality of plates.

9. The apparatus of claim 8 wherein each of said adjusting studs includes a conical end.

10. The apparatus of claim 8 wherein each of said metal rings reduces the diameter of each of said respective alignment holes.

11. The apparatus of claim 8 wherein said adjustable slider includes a plurality of recesses for engagement by a pin for providing a horizontal alignment of said second plate.

12. The apparatus of claim 11 wherein said pin of said adjustable slider is spring loaded for forced engagement with said plurality of recesses.

13. The apparatus of claim 8 wherein said adjustable slider is capable of horizontal and vertical adjustment.

14. A method for the assembly of a video display device, said method comprising the steps of:

providing a base plate and a holding device attached to said base plate;

mounting an adjustable slider to said holding device for aligning at least one of a plurality of structured plates;

affixing at least a first of a plurality of adjusting studs in the bottom of said base plate for aligning at least a first of said plurality of structured plates;

affixing at least a second of said plurality of adjusting studs to said adjustable slider for aligning at least a second of said plurality of structured plates;

machining a plurality of alignment holes in each of said structured plates and fitting a metal ring to each of said alignment holes;

withdrawing said adjusting studs and mounting said plurality of structural plates on said base plate;

engaging each of said metal rings with one of said plurality of adjusting stud for vertically and horizontally aligning said plurality of structured plates;

placing a spacing frame and a screen plate above said plurality of structured plates for vertical and horizontal alignment;

joining said plurality of structured plates, said spacing frame and said screen plate at an elevated temperature; and withdrawing said adjusting studs from said video display device.

* * * * *

UNITED STATES PATENT AND TRADEMARK OFFICE

CERTIFICATE OF CORRECTION

PATENT NO. : 4,708,678

DATED : November 24, 1987

INVENTOR(S) : Tischer et al.

It is certified that error appears in the above-identified patent and that said Letters Patent is hereby corrected as shown below:

On the Front Page

[73] Assignee: Change "Standard Elektrik Lorenz, Stuttgart, Fed. Rep. of Germany" to -- Standard Elektrik Lorenz AG, Stuttgart; Siemens AG, Munich, both of Fed. Rep. of Germany --

Column 1, Line 30: Change "andother" to -- and other --

Column 3, Line 41: Change "122" to -- 112 --

Column 3, Lines 47,48: Change "adjustment" to -- adjustable --

Column 4, Line 2: After "216" delete the "," and insert therefor -- . --

In the Claims

Column 5, Line 5: Change "hoels" to -- holes --

Signed and Sealed this

Thirtieth Day of August, 1988

*Attest:*

*Attesting Officer*

DONALD J. QUIGG

*Commissioner of Patents and Trademarks*